US009351391B2

(12) United States Patent
Verbruggen

(10) Patent No.: US 9,351,391 B2
(45) Date of Patent: May 24, 2016

(54) RF SYSTEM FOR SYNCHROCYCLOTRON

(71) Applicant: Ion Beam Applications, Louvain-la-Neuve (BE)

(72) Inventor: Patrick Verbruggen, Orbaix (BE)

(73) Assignee: Ion Beam Applications, Louvain-la-Neuve (BE)

( * ) Notice: Subject to any disclaimer, the term of this patent is extended or adjusted under 35 U.S.C. 154(b) by 0 days.

(21) Appl. No.: 14/358,716

(22) PCT Filed: Nov. 15, 2012

(86) PCT No.: PCT/EP2012/072682
§ 371 (c)(1),
(2) Date: May 15, 2014

(87) PCT Pub. No.: WO2013/072397
PCT Pub. Date: May 23, 2013

(65) Prior Publication Data

US 2014/0320044 A1 Oct. 30, 2014

Related U.S. Application Data

(60) Provisional application No. 61/560,907, filed on Nov. 17, 2011.

(30) Foreign Application Priority Data

Nov. 17, 2011 (EP) ..... 11189533

(51) Int. Cl.
*H05H 7/02* (2006.01)
*H05H 13/02* (2006.01)

(52) U.S. Cl.
CPC ..... *H05H 13/02* (2013.01); *H05H 7/02* (2013.01); *H05H 2007/025* (2013.01); *Y10T 29/49117* (2015.01)

(58) Field of Classification Search
CPC ..... H05H 7/00; H05H 15/00; H05H 13/00
USPC ..... 315/500, 501, 502, 503
See application file for complete search history.

(56) References Cited

U.S. PATENT DOCUMENTS 4,663,932 A * 5/1987 Cox ..... 60/200.1
4,891,600 A * 1/1990 Cox ..... 315/501

(Continued)

OTHER PUBLICATIONS

International Search Report and Written Opinion dated Jan. 2, 2013.
Schneider R. et al: "Nevis Synchrocyclotron Conversion Program-R.F. System", IEEE Transactions on Nuclear Science, IEEE Service Center, New York, NY, US, vol. ns16, No. 3, Jun. 1, 1969, pp. 430-433.

(Continued)

*Primary Examiner* — Douglas W Owens
*Assistant Examiner* — Syed M Kaiser
(74) *Attorney, Agent, or Firm* — Lowenstein Sandler LLP

(57) ABSTRACT

The present invention relates to an RF system (1) able to generate a voltage for accelerating charged particles in a synchrocyclotron, the RF system (1) including a resonant cavity (2) comprising a conducting enclosure (5) within which are placed a conducting pillar (3) of which a first end is linked to an accelerating electrode (4) able to accelerate the charged particles, a rotary variable capacitor (10) coupled between a second end opposite from the first end of the pillar (3) and the conducting enclosure (5), the said capacitor (10) comprising fixed electrodes (11) and a rotor (13) comprising mobile electrodes (12), the fixed electrodes (11) and the mobile electrodes (12) forming a variable capacitance able to vary a resonant frequency of the resonant cavity (2) in a cyclic manner over time, an exterior layer of the rotor (13) having a conductivity of greater than 20,000,000 S/m at 300 K. At least one part of the exterior surface (15) of the rotor (13) is a surface possessing a normal total emissivity of greater than 0.5 and less than 1, thereby allowing better cooling of the rotor and/or making it possible to dispense with a system for cooling the rotor by conduction and/or by convection.

16 Claims, 6 Drawing Sheets

(56) References Cited

U.S. PATENT DOCUMENTS

| | | | | |
|---|---|---|---|---|
| 8,653,762 | B2 * | 2/2014 | Eriksson et al. | 315/501 |
| 2006/0058185 | A1 * | 3/2006 | Cendak et al. | 502/326 |
| 2009/0140671 | A1 * | 6/2009 | O'Neal et al. | 315/502 |
| 2009/0321026 | A1 * | 12/2009 | Medoff | 162/50 |
| 2010/0108567 | A1 * | 5/2010 | Medoff | 208/49 |

OTHER PUBLICATIONS

R. Schneider, et al., "Nevis Synchrocyclotron Conversion Program-RF System," IEEE Transactions on Nuclear Science, vol. 8, issue 3, pp. 303-306 (1971).

* cited by examiner

RF SYSTEM FOR SYNCHROCYCLOTRON

CROSS-REFERENCE TO RELATED APPLICATIONS

This application is a national stage entry under 35 U.S.C. §371 of International Application No. PCT/EP2012/072682, filed Nov. 15, 2012, which claims the benefit of priority of European Application No. 11189533.0, filed Nov. 17, 2011, and U.S. Provisional Patent Application No. 61/560,907, filed Nov. 17, 2011, the disclosures of which are hereby incorporated by reference herein in their entirety.

FIELD OF THE INVENTION

The present invention pertains to the field of synchrocyclotrons. More particularly, the invention relates to a radio-frequency (RF) system able to generate a voltage for accelerating charged particles in a synchrocyclotron, the RF system including a resonant cavity comprising a conducting enclosure within which are placed a conducting pillar of which a first end is linked to an accelerating electrode able to accelerate the charged particles, and a rotary variable capacitor coupled between a second end opposite from the first end of the pillar and the conducting enclosure, the said capacitor comprising fixed electrodes and a rotor comprising mobile electrodes, the fixed electrodes and the mobile electrodes forming a variable capacitance able to vary a resonant frequency of the resonant cavity in a cyclic manner over time, an exterior layer of the rotor having a conductivity of greater than 20,000,000 S/m at 300 K.

BACKGROUND OF THE INVENTION

Such RF systems, furnished with a rotary variable capacitor, have been known for a long time, for example from patent GB-655271. It is also known that the rotor of the capacitor is prone to heating which is in part due to the eddy currents which appear in the rotor subsequent to the rotary motion of the latter in the magnetic field of the synchrocyclotron, that is to say in the magnetic field which makes it possible to maintain the particles in their trajectory within the synchrocyclotron. Other causes of heating are the RF currents which traverse the rotor. Now, this heating causes deformations in the geometry of the rotor, and this may disturb its proper operation. It can also lead to premature aging of the materials of which the capacitor is composed and/or which are in contact with it.

In the known RF systems, the rotor is generally cooled by water, as described for example by K. A. Bajcher et al, ("improvements in the operational reliability of the 680 mev synchro-cyclotron as a result of the modernization of its rf system"; joint institute for nuclear research, Dubna report 9-6218). The rotor can also be cooled by air and water, as described in "design of the radio-frequency system for the 184-inch cyclotron" by K. R. MacKenzie et al. However, this system requires the manufacture of a complex labyrinthine network of flexible pipes and the addition of air blowers and a system for evacuating this air.

Such cooling systems are complex, expensive, and often rather unreliable. They are also sometimes inadequate and then require additional thermal protection measures for sensitive elements. In this regard, Bachjer et al. describe for example that they furnish certain parts of the capacitor with magnetic screens so as to limit the eddy currents in these capacitor parts. These known cooling means are moreover increasingly difficult and expensive to implement as RF powers increase and/or the rotation speed of the rotor increases, this being the case in the synchrocyclotrons which are undergoing development and which are aimed at increasing the number of packets of particles that they can produce per unit time.

SUMMARY OF THE INVENTION

One of the aims of the present invention is to solve at least partially the problems related to the cooling of the rotor of the variable capacitor.

To this end, the RF system according to the present invention is characterized in that at least one part of an exterior surface of the rotor facing an interior surface of the conducting enclosure possesses a normal total emissivity of greater than or equal to 0.5 and less than 1.

Such an RF system indeed makes it possible to increase the transfer of heat in the form of radiation from the rotor to the conducting enclosure, thus allowing better cooling of the rotor. This is particularly advantageous when the rotor rotates at high speeds, such as for example speeds greater than 5000 revolutions per minute.

Alternatively or additionally, at least one part of the interior surface of the conducting enclosure that may at one moment or another be facing the exterior surface of the rotor possesses a normal total emissivity of greater than or equal to 0.5 and less than 1.

Such a configuration makes it possible to improve the absorbance of the thermal radiation emitted by the exterior surface of the exterior layer of the rotor and thus to cool the rotor even better.

In a preferential manner, the RF system according to the invention does not comprise any means for cooling the rotor by forced convection of a fluid which would be in direct contact with the rotor. Such a configuration makes it possible to have a greatly simplified and less expensive RF system, while preserving comparable heat dissipation properties, and allowing the use of this RF system in a synchrocyclotron.

The invention also pertains to a process for manufacturing an RF system. The invention also pertains to a synchrocyclotron comprising such an RF system.

These aspects as well as other aspects of the invention will be clarified in the detailed description of particular embodiments of the invention.

BRIEF DESCRIPTION OF THE DRAWINGS

The figures are given by way of indication and do not constitute any limitation of the present invention. Moreover, the proportions of the drawings are not complied with. Identical or analogous components are generally designated by the same reference numbers among all the figures.

DETAILED DESCRIPTION OF PARTICULAR EMBODIMENTS OF THE INVENTION

Note that within the framework of the present invention, "RF" should be understood to mean a radiofrequency, that is to say a frequency lying between 3 KHz and 300 GHz. In a synchrocyclotron, this frequency varies for example between 59 MHz and 88 MHz.

Figure 1:
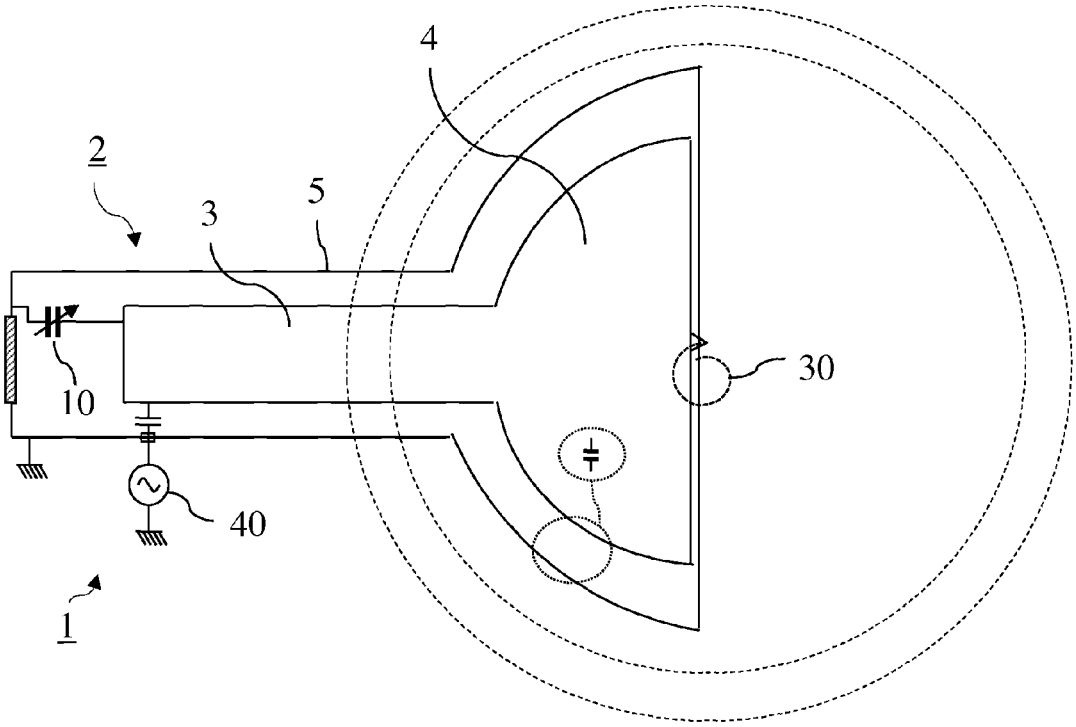
FIG. 1 represents a basic view of an RF system of a synchrocyclotron represented according to a mid-plane.

FIG. 1 represents firstly in a general and schematic way an RF system (1) according to the invention. This RF system includes a resonant cavity (2) comprising a conducting enclosure (5) within which are placed a conducting pillar (3) of which a first end is linked to an accelerating electrode (4) able to accelerate the charged particles along a desired trajectory (30) in the synchrocyclotron, a rotary variable capacitor (10) (also called a "rotco") coupled between a second end opposite from the first end of the pillar (3) and the conducting enclosure (5) and whose variable capacitance is able to vary a resonant frequency of the resonant cavity (2) in a cyclic manner over time. The said variable capacitor (10) comprises fixed electrodes and a rotor comprising mobile electrodes, the fixed electrodes and the mobile electrodes forming the said variable capacitance. In operation, the rotor rotates preferably at a speed greater than 5000 revolutions per minute.

It should be noted that, when the RF system is mounted on a synchrocyclotron and is in operation, the interior of the conducting enclosure (5) is generally under a very low pressure, or indeed under a quasi-vacuum, for example under a pressure of less than $10^{-3}$ mbar, preferably at a pressure of between $10^{-4}$ mbar and $10^{-6}$ mbar.

An RF generator (40), which can for example be coupled in a capacitive manner to the pillar (3), is used to feed the cavity (2). In the case illustrated, the generator (40) and the conducting enclosure (5) are earthed.

Figure 2:
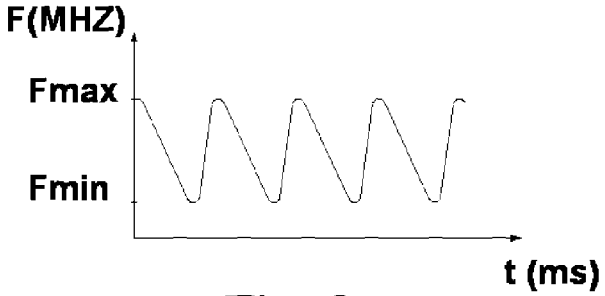
FIG. 2 represents a tempo-frequency structure of an accelerating electric field in a synchrocyclotron.

FIG. 2 represents a tempo-frequency structure of an accelerating electric field such as generated by the accelerating electrode (4) of such an RF system.

Such a system being known, it will not be described in greater detail here.

Attention is now turned to the part of the RF system situated on the variable capacitor (10) side, that is to say the part situated opposite to the accelerating electrode (4) with respect to the pillar (3).

Figure 3A:
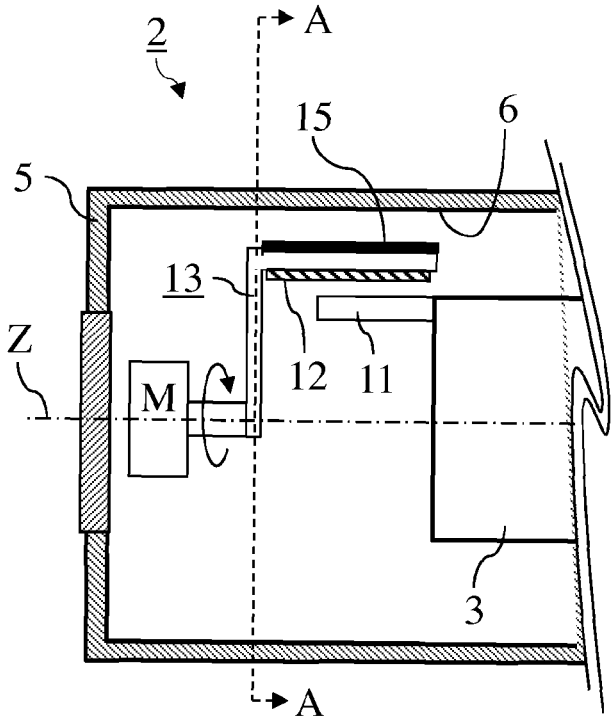
FIG. 3*a* represents a partial longitudinal sectional view of an RF system according to a first embodiment of the invention.
Figure 3B:
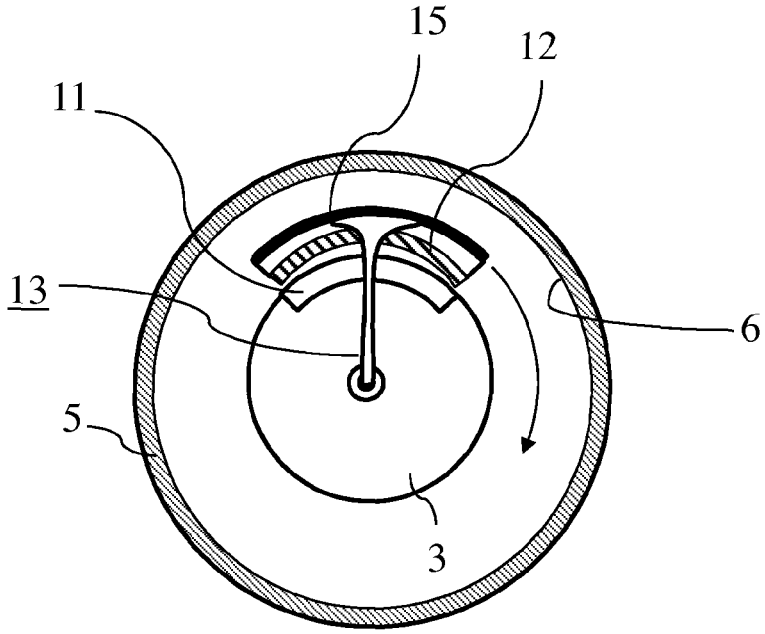
FIG. 3*b* represents a transverse sectional view according to the plane AA of the RF system of FIG. 3*a;*

FIG. 3*a* and FIG. 3*b* represent respectively a partial longitudinal section and a transverse section "AA" through an RF system according to the invention.

The rotco comprises a fixed electrode (11) which is fixed to the second end opposite from the first end of the pillar (3). The rotco also comprises a rotor (13) on which a mobile electrode (12) is mounted. The rotor (13) can for example be driven in rotation by a motor (M) about a rotation axis (Z) which is parallel to—or coincides with—an axis of the pillar (3). The fixed electrode (11) and the mobile electrode (12) extend axially along the Z axis and will thus face one another in a cyclic manner when the motor (M) is in operation. The rotco will thus exhibit a capacitance which varies cyclically with time. For the sake of clarity, the rotco illustrated in FIGS. 3*a* and 3*b* comprises a single fixed electrode (11) and a single mobile electrode (12). However, the rotco will in general comprise several fixed and/or mobile electrodes. It will also be obvious that many other rotco configurations are possible within the framework of the present invention.

An exterior layer of the rotor (13) has a conductivity of greater than $20\times10^6$ S/m at 300 K (i.e. 20,000,000 Siemens per meter at 300 Kelvin), thereby allowing good conduction of the RF currents in the rotor. In a preferential manner, the exterior layer of the rotor (13) possesses an electrical conductivity equal to or greater than that of aluminum (i.e. about $37.7\times10^6$ S/m at 300 K). It may for example be a copper or silver layer. Preferably, this layer is for example made of copper. Provision may thus be made for example for a rotor made of aluminum, or aluminum alloy, for example series 7000, overlaid with a copper layer on its exterior part. The term "layer" should also be understood to mean a "region" or a "zone". It is thus also possible to have a hefty copper rotor for example, in which case an exterior zone of the rotor will of course be made of copper.

As represented schematically in FIGS. 3*a* and 3*b*, at least one part of an exterior surface (15) of the rotor (13) situated facing an interior surface (6) of the conducting enclosure (5) possesses a normal total emissivity of greater than or equal to 0.5 and less than 1.

Figure 4A:
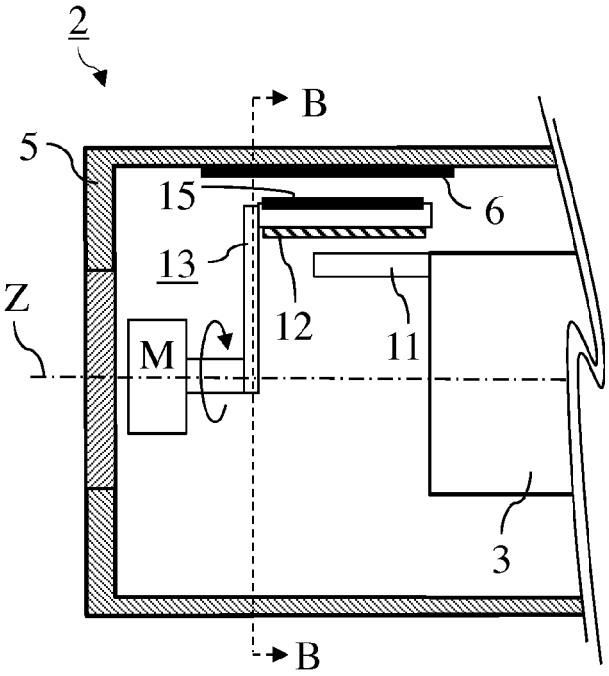
FIG. 4*a* represents a partial longitudinal sectional view of an RF system according to an alternative or additional mode of the invention.
Figure 4B:
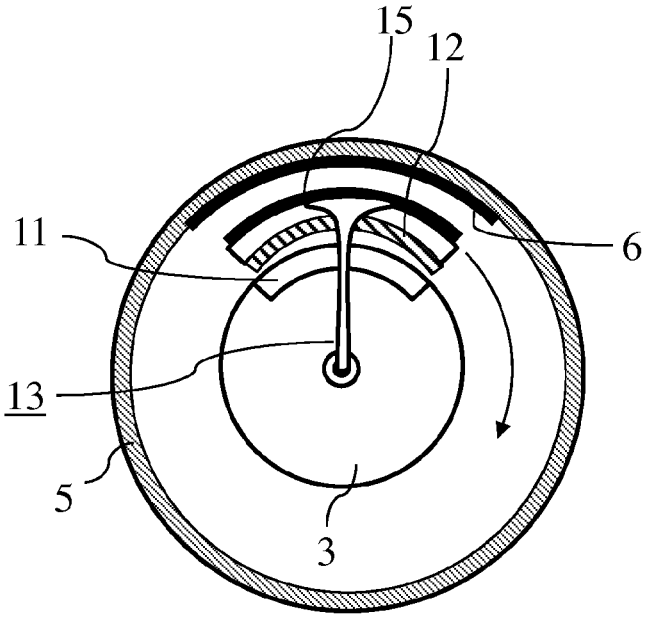
FIG. 4*b* represents a transverse sectional view according to the plane BB of the RF system of FIG. 4*a;*

Alternatively, or in addition, as illustrated in FIGS. 4*a* and 4*b*, at least one part of the interior surface (6) of the conducting enclosure (5) that may at one moment or another be facing the exterior surface (15) of the rotor (13) possesses a normal total emissivity of greater than or equal to 0.5 and less than 1.

The term "facing" signifies that, at one moment or another, the said two surfaces (6 and 15) are opposite one another so that a straight line can be traced between the said two surfaces without this line encountering any obstacle.

This normal total emissivity is measured in accordance with method A of ASTM standard E408-71(2008) ("Standard test methods for total normal emittance of surfaces using inspection-meter techniques") at a temperature of 300 K. During the calibration of a measurement apparatus in accordance with this standard, a reference surface having substantially the same radius of curvature as the radius of curvature of the surface considered at the location of the measurement will be used in preference.

Preferably, the RF system (1) according to the invention does not comprise any means for cooling the rotor (13) by forced convection of a fluid in direct contact with the said rotor (13).

Preferably, at least 50%, or at least 60%, or at least 70%, or at least 80%, or at least 90%, or 100%, of the exterior surface (15) of the rotor (13) situated facing an interior surface (6) of the conducting enclosure (5) possesses a normal total emissivity of greater than or equal to 0.5 and less than 1, preferably greater than 0.6 and less than 1, preferably greater than 0.7 and less than 1, preferably greater than 0.8 and less than 1, preferably greater than 0.9 and less than 1, preferably greater than 0.95 and less than 1.

In an alternative or additional manner, at least 50%, or at least 60%, or at least 70%, or at least 80%, or at least 90%, or 100%, of the interior surface (6) of the conducting enclosure (5) that may at one moment or another be facing the exterior surface (15) of the rotor (13) possesses a normal total emissivity of greater than or equal to 0.5 and less than 1, preferably greater than 0.6 and less than 1, preferably greater than 0.7 and less than 1, preferably greater than 0.8 and less than 1, preferably greater than 0.9 and less than 1, preferably greater than 0.95 and less than 1.

Figure 5A:
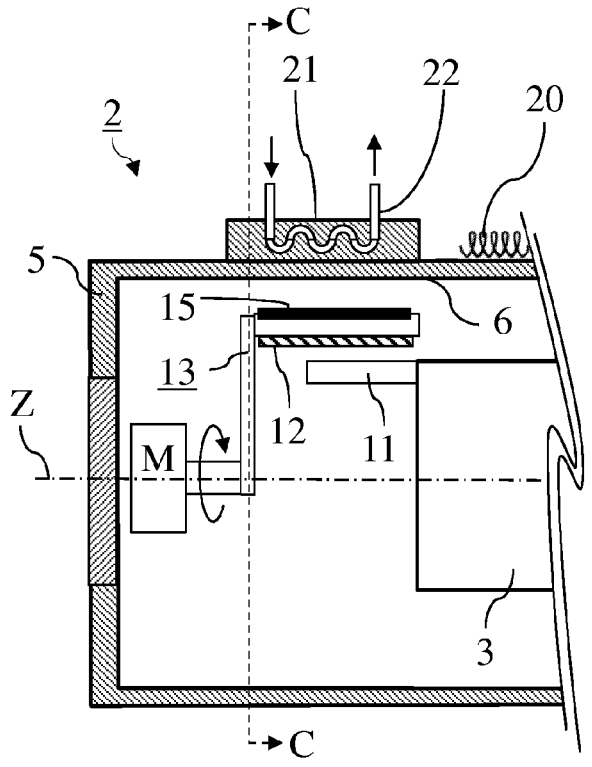
FIG. 5*a* represents a partial longitudinal sectional view of an RF system according to a more preferred mode of the invention.
Figure 5B:
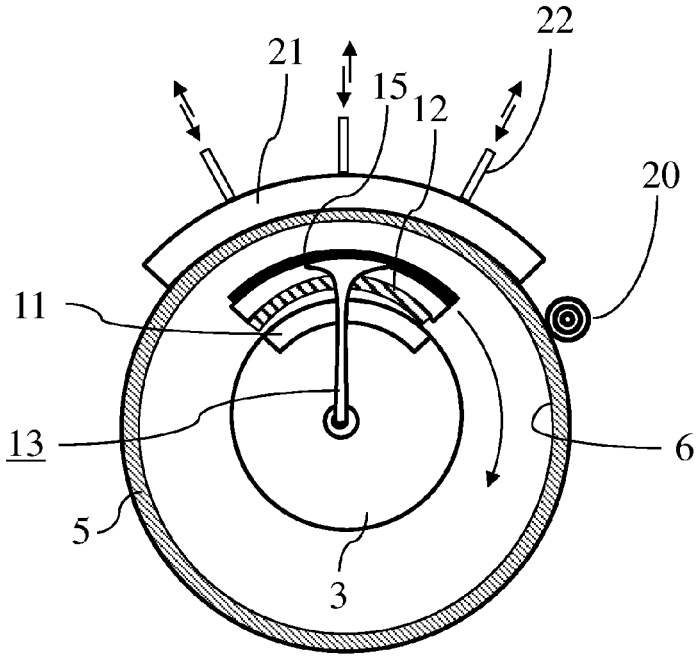
FIG. 5*b* represents a transverse sectional view according to the plane CC of the RF system of FIG. 5*a;*

According to a preferred embodiment of the invention, illustrated in FIGS. 5*a* and 5*b*, the RF system (1) moreover comprises first means (20) for cooling the conducting enclosure (5) by forced convection, as well as second means (21) for cooling the conducting enclosure (5) by forced convection, the said second means (21) being additional to the first means (20) and being situated at the level of the rotor (13).

These second means (21) therefore constitute an additional means for better evacuation of the heat radiated by the exterior surface (15) of the rotor (13) and absorbed by the enclosure (5). These first and second means (20, 21) can for example be cooling means using liquid or using gas. For example, the second means (21) can comprise pipes (22)—suited to the circulation of liquid nitrogen or of any cryogenic liquid—placed in direct or indirect contact with the conducting enclosure (5). These second means (21) can comprise a plurality of cooling means distributed over the exterior surface of the conducting enclosure (5) at the level of the rotor (13).

The normal total emissivity levels specified hereinabove may be attained in various ways, as will be described hereinafter.

The exterior surface (15) of the rotor (13) may at least in part be made of a conducting diamagnetic material or a semi-conducting diamagnetic material, this surface possessing a normal total emissivity of greater than or equal to 0.5 and less than 1. Diamagnetic materials are materials which possess a negative magnetic susceptibility. The materials can for example be a conducting material, such as a graphite, carbon nanotubes, carbon black or platinum black. Alternatively, these materials may be a semi-conducting material, preferably devoid of impurities. The materials may be compounds. The term compound defines a chemical substance composed of at least two different chemical elements such as for example silicon carbide (SiC), cuprous oxide ($Cu_2O$), cupric oxide (CuO) or silver oxide (AgO).

According to a preferred embodiment of the invention, the at least one part of the exterior surface (15) of the rotor (13) is made of a copper oxide. This copper oxide may be a cupric oxide (or copper (II) oxide or CuO) or a cuprous oxide (or copper (I) oxide or $Cu_2O$). In a preferential manner, copper (II) oxide will be used.

In an alternative manner, the at least one part of the exterior surface (15) of the rotor (13) comprises a material selected from among graphite carbon, carbon nanotubes, silicon carbide, platinum black, or carbon black.

Alternatively, the at least one part of the exterior surface (15) of the rotor (13) is made of copper, or copper oxide, and has undergone a surface treatment by mechanical impact such as shot peening, sand-blasting, shot-blasting, abrasion, boring or a combination of these processes.

Figure 6A:
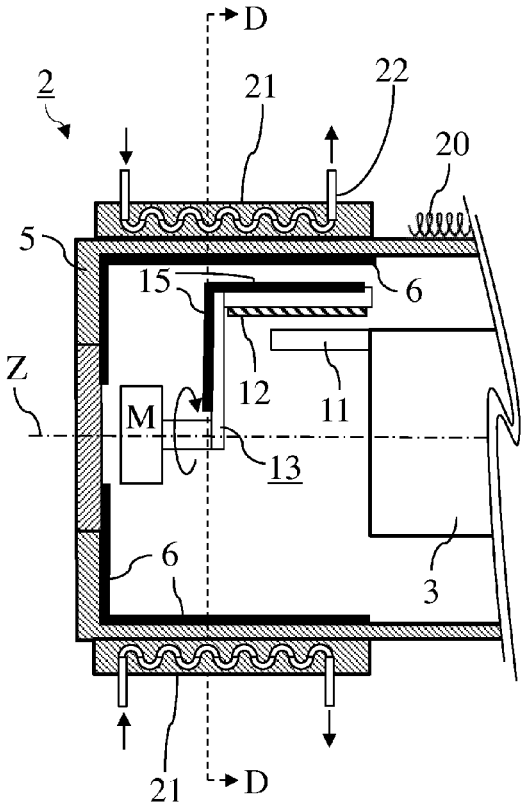
FIG. 6*a* represents a partial longitudinal sectional view of an RF system according to a still more preferred mode of the invention.
Figure 6B:
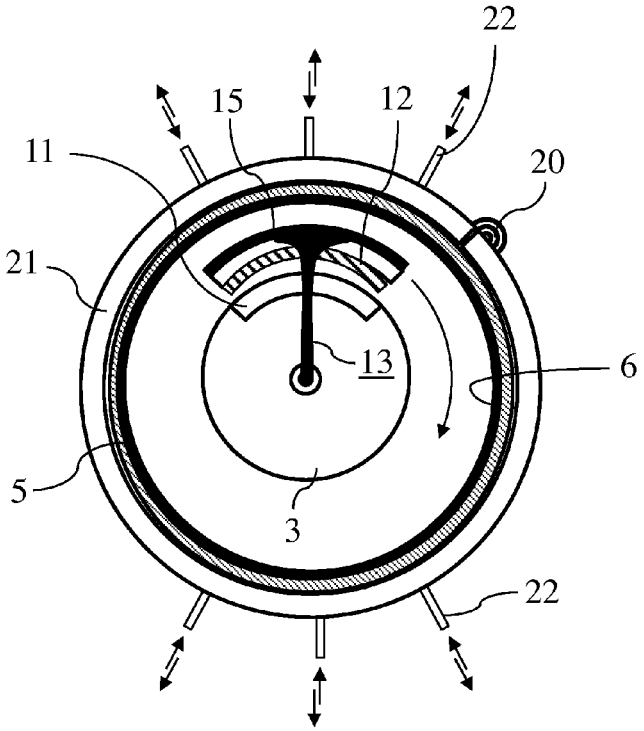
FIG. 6*b* represents a transverse sectional view according to the plane DD of the RF system of FIG. 6*a;*

In a still more preferred manner, such as illustrated in FIG. 6*a* and in FIG. 6*b*, the entirety of the interior surface (6) of the conducting enclosure (5) that may at one moment or another be facing the exterior surface (15) of the rotor (13) possesses a normal total emissivity of greater than or equal to 0.5 and less than 1, preferably greater than 0.6 and less than 1, preferably greater than 0.7 and less than 1, preferably greater than 0.8 and less than 1, preferably greater than 0.9 and less than 1, preferably greater than 0.95 and less than 1.

In an alternative or additional manner, the at least one part of the interior surface (6) of the conducting enclosure (5) that may at one moment or another be facing the exterior surface (15) of the rotor (13) is made of copper oxide. This copper oxide may be a copper (I) oxide or a copper (II) oxide. In a still more preferred manner, the at least one part of the interior surface (6) of the conducting enclosure (5) is made of copper (II) oxide.

Alternatively, the at least one part of the interior surface (6) of the conducting enclosure (5) comprises a material chosen from among graphite carbon, carbon nanotubes, silicon carbide, graphite black or carbon black.

Alternatively, the at least one part of the interior surface (6) of the conducting enclosure (5) is made of copper, or copper oxide, and has undergone a surface treatment by mechanical impact such as shot peening, sand-blasting, shot-blasting, abrasion, boring or a combination of these processes.

According to a more preferred embodiment of the invention, the at least one part of an exterior surface (15) of the exterior layer of the rotor (13) and the at least one part of an interior surface (6) of the conducting enclosure (5) are from one and the same material.

This indeed makes it possible to maximize the heat transfer by radiation from the rotor to the conducting enclosure since the surfaces concerned will thus have substantially the same emissivity spectra in the frequency domain.

Preferably, the said at least one part of an exterior surface (15) of the rotor (13) is made of copper (II) oxide and the said at least one part of the interior surface (6) of the conducting enclosure (5) is made of copper (II) oxide.

Alternatively, the said at least one part of an exterior surface (15) of the rotor (13) is made of copper (I) oxide and the said at least one part of the interior surface (6) of the conducting enclosure (5) is made of copper (I) oxide. Alternatively, the said at least one part of an exterior surface (15) of the rotor (13) is made of graphite carbon, carbon nanotubes, silicon carbide, platinum black or carbon black and the said at least one part of the interior surface (6) of the conducting enclosure (5) is respectively made of graphite carbon, carbon nanotubes, silicon carbide, platinum black or carbon black.

Alternatively, the said at least one part of an exterior surface (15) of the rotor (13) is made of copper and has undergone a surface treatment by mechanical impact such as shot peening, sand-blasting, shot-blasting, abrasion, boring, or a combination of these processes and the said at least one part of the interior surface (6) of the conducting enclosure (5) is made of copper and has undergone the same mechanical treatment by impact such as shot peening, sand-blasting, shot-blasting, abrasion, boring, or a combination of these processes. In a preferential manner, the exterior surface (15) of the rotor (13) and the interior surface (6) of the conducting enclosure (5) also undergo an oxidizing step after the step of treatment by mechanical impact.

Figure 7A:
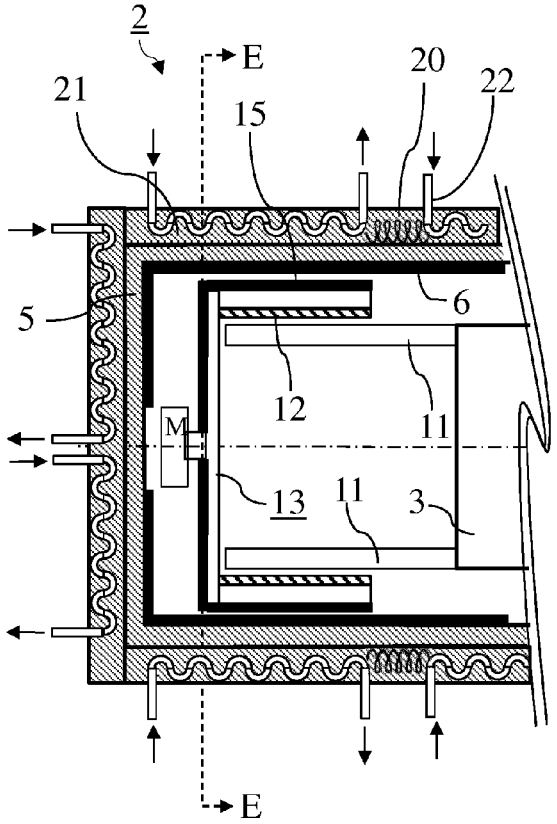
FIG. 7*a* represents a partial longitudinal sectional view of an RF system according to a still more preferred mode of the invention.
Figure 7B:
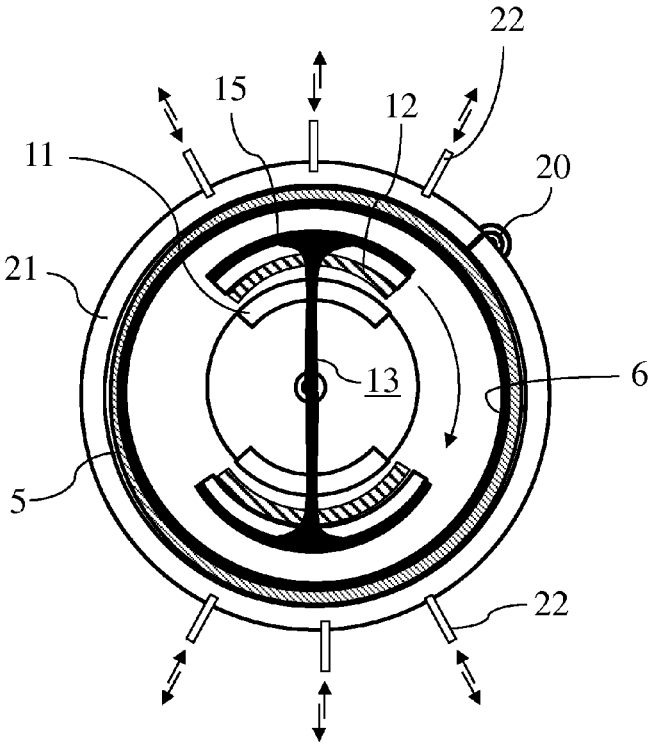
FIG. 7*b* represents a transverse sectional view according to the plane EE of the RF system of FIG. 7*a.*

In a still more preferred embodiment of the invention, such as illustrated in FIG. 7*a* and in FIG. 7*b*, the rotor (13) comprises a plurality of mobile electrodes (12), and a plurality of fixed electrodes (11). The second cooling means (22) may be present on the entirety of the exterior surface of the conducting enclosure (5) at the level of the rotor (13).

The invention also relates to a synchrocyclotron comprising an RF system such as described in any one of the above examples.

Another aspect of the invention relates to a process for manufacturing an RF system (1) able to generate a voltage for accelerating charged particles in a synchrocyclotron, the RF system (1) including a resonant cavity (2) comprising a conducting enclosure (5) within which are placed a conducting pillar (3) of which a first end is linked to an accelerating electrode (4) able to accelerate the charged particles, a rotary variable capacitor (10) coupled between a second end opposite from the first end of the pillar (3) and the conducting enclosure, the said capacitor comprising fixed electrodes (11) and a rotor (13) comprising mobile electrodes (12), the fixed electrodes (11) and the mobile electrodes (12) forming a variable capacitance able to vary a resonant frequency of the resonant cavity (2) in a cyclic manner over time, an exterior layer of the rotor (13) having a conductivity of greater than 20,000,000 S/m at 300 K, characterized in that the said process comprises a step of surface treatment substantially increasing the normal total emissivity of at least one part of an exterior surface (15) of the rotor (13) facing an interior surface (6) of the conducting enclosure (5).

Alternatively or additionally, the process comprises a step of surface treatment of at least one part of an interior surface (6) of the conducting enclosure (5) that may at one moment or another be facing the exterior surface (15) of the rotor (13), the said surface treatment substantially increasing the normal total emissivity of at least one part of an interior surface (6) of the conducting enclosure (5) that may at one moment or another be facing the exterior surface (15) of the rotor (13).

The expression "substantial increase in the emissivity" should be understood to mean that the normal total emissivity after the treatment step ($\epsilon_2$) is related to the normal total emissivity before the treatment step ($\epsilon_1$) according to the formula:

$$\epsilon_2 > \epsilon_1 + k \cdot (1 - \epsilon_1)$$

in which k=0.1.

In a preferred manner, k=0.2; or k=0.3; or k=0.4; or k=0.5.

Preferably, the normal total emissivity after the treatment step ($\epsilon_2$) is greater than 0.5 and less than 1, preferably greater than 0.6 and less than 1, preferably greater than 0.7 and less than 1, preferably greater than 0.8 and less than 1, preferably greater than 0.9 and less than 1, preferably greater than 0.95 and less than 1.

These values of normal total emissivity are measured in accordance with method A of ASTM standard E408-71 (2008) ("Standard test methods for total normal emittance of surfaces using inspection-meter techniques") at a temperature of 300 K. During the calibration of a measurement apparatus in accordance with this standard, a reference surface having substantially the same radius of curvature as the radius of curvature of the surface considered at the location of the measurement will be used by preference.

According to a preferred embodiment of the processes previously described, the process does not comprise any step for furnishing the RF system (1) with means for cooling the rotor (13) by forced convection of a fluid in direct contact with the said rotor (13).

In a preferential manner, at least one part of the exterior layer of the rotor (13) is made of copper, and the said step of surface treatment comprises a step of oxidizing at least one part of the exterior surface (15) of the exterior layer of the rotor (13).

In an alternative manner, at least one part of the exterior layer of the rotor (13) is made of copper, and the said step of surface treatment comprises a step of mechanically increasing the roughness of at least one part of the exterior surface (15) of the exterior layer of the rotor (13), such as for example a step of mechanical treatment by impact such as shot peening, sand-blasting, shot-blasting, abrasion, boring or a combination of these processes, of the said at least one part of the exterior surface (15) of the exterior layer of the rotor (13). In a more preferential manner, at least one part of the exterior layer of the rotor (13) is made of copper, and the said step of surface treatment comprises a step of mechanically increasing the roughness of at least one part of the surface (15) of the exterior layer of the rotor (13), such as for example a step of mechanical treatment by impact such as shot peening, sand-blasting, shot-blasting, abrasion, boring or a combination of these processes, of the said at least one part of the exterior surface (15) of the exterior layer of the rotor (13), followed by a step of oxidizing at least one part of the exterior surface (15) of the exterior layer of the rotor (13).

The surface roughness is defined as being the ratio of the real surface area to the geometric surface area. A mechanical increase in the surface roughness signifies that the roughness after treatment ($R_2$) is greater than the surface roughness before treatment ($R_1$) according to the formula:

$$R_2 > (1+x) \cdot R_1$$

with x=0.1.

Preferably, x=0.2; or x=0.3; or x=0.4; or x=0.5.

A step of the process may be the overlaying of at least one part of the exterior layer of the rotor (13) with a layer consisting of a conducting diamagnetic material or of a semi-conducting diamagnetic material, the exterior surface (15) of the layer possessing a normal total emissivity of greater than or equal to 0.5 and less than 1. These materials may for example be a conducting material, such as a graphite, carbon nanotubes, carbon black or platinum black. Alternatively, these materials may be an inorganic semi-conducting compound, preferably devoid of impurities, such as for example silicon carbide (SiC), cuprous oxide ($Cu_2O$), cupric oxide (CuO) or silver oxide (AgO).

In a preferred manner, the said step of surface treatment comprises a step of overlaying at least one part of the exterior layer of the rotor (13) with a layer comprising a material chosen from among graphite carbon, carbon nanotubes, silicon carbide, platinum black, carbon black or a combination of these materials.

Alternatively or complementarily, the process comprises a step of treating the interior surface (6) of the conducting enclosure (5) that may at one moment or another be facing the exterior surface (15) of the rotor (13). This step of surface treatment may be a step of overlaying the interior surface (6) of the conducting enclosure (5) with a layer consisting of a conducting diamagnetic material or of a semi-conducting diamagnetic material, the interior surface (6) of the conducting enclosure (5) after treatment possessing a normal total emissivity of greater than or equal to 0.5 and less than 1.

In an alternative or complementary manner, the interior surface (6) of the conducting enclosure (5) is made of copper, and the said step of surface treatment comprises a step of oxidizing at least one part of the interior surface (6) of the conducting enclosure (5). This oxidizing step may transform the copper into copper (I) oxide or into copper (II) oxide.

In an alternative manner, the interior surface (6) of the conducting enclosure (5) is made of copper, and the said step of surface treatment comprises a step of mechanically increasing the roughness by a mechanical treatment by impact such as shot peening, sand-blasting, shot-blasting, abrasion, boring or a combination of these processes, of at least one part of the interior surface (6) of the conducting enclosure (5).

In a still more preferential manner, the interior surface (6) of the conducting enclosure (5) is made of copper, and the said step of surface treatment comprises a step of mechanically increasing the roughness by a mechanical treatment by impact such as shot peening, sand-blasting, shot-blasting, abrasion, boring or a combination of these processes, of at least one part of the interior surface (6) of the conducting enclosure (5) followed by a step of oxidizing at least one part of the interior surface (6) of the conducting enclosure (5).

In an alternative manner, the said step of surface treatment of the interior surface (6) of the conducting enclosure (5) comprises the overlaying of this surface with one of graphite carbon, carbon nanotubes, silicon carbide, platinum black, carbon black or a combination of these materials.

In a preferred manner, the step of surface treatment of the exterior surface (15) of the rotor (13) and the step of surface treatment of the interior surface (6) of the conducting enclosure (5) are identical.

Preferably, the RF system according to the invention does not comprise any means for cooling the rotor by forced convection of a fluid which would be in direct contact with the rotor, such as for example means for cooling by forced circulation of a liquid and/or of a gas in the rotor. This does not exclude however that components that are in contact with the rotor, such as for example roller bearings bracing an axis of the rotor, are cooled by forced convection of a fluid. Forced convection should be understood to mean that the fluid circulates by virtue of non-natural means, such as by virtue of a pump for example.

The invention can also be summarized as follows: an RF system (1) able to generate a voltage for accelerating charged particles in a synchrocyclotron, the RF system (1) including a resonant cavity (2) comprising a conducting enclosure (5) within which are placed a conducting pillar (3) of which a first end is linked to an accelerating electrode (4) able to accelerate the charged particles, a rotary variable capacitor (10) coupled between a second end opposite from the first end of the pillar (3) and the conducting enclosure (5), the said capacitor (10) comprising fixed electrodes (11) and a rotor (13) comprising mobile electrodes (12), the fixed electrodes (11) and the mobile electrodes (12) forming a variable capacitance able to vary a resonant frequency of the resonant cavity (2) in a cyclic manner over time, an exterior layer of the rotor (13) having a conductivity of greater than 20,000,000 S/m at 300 K. At least one part of the exterior surface (15) of the rotor (13) is a surface possessing a normal total emissivity of greater than 0.5 and less than 1, thereby allowing better cooling of the rotor and/or making it possible to dispense with a device for cooling the rotor by conduction and/or by convection.

The present invention has been described in conjunction with specific embodiments, which have a purely illustrative value and must not be considered to be limiting. In a general way, it will be obviously apparent to the person skilled in the art that the present invention is not limited to the examples illustrated and/or described hereinabove. The presence of reference numbers in the drawings cannot be considered to be limiting, including when these numbers are indicated in the claims.

The use of the verbs "comprise", "include", or any other variant, as well as their conjugation, cannot in any way exclude the presence of elements other than those mentioned. The use of the indefinite article "a", "an", or of the definite article "the", to introduce an element does not exclude the presence of a plurality of these elements.

What is claimed is:

1. An RF system able to generate a voltage for accelerating charged particles in a synchrocyclotron, the RF system including a resonant cavity comprising a conducting enclosure within which are placed:

a conducting pillar of which a first end is linked to an accelerating electrode able to accelerate the charged particles; and a rotary variable capacitor coupled between a second end opposite from the first end of the pillar and the conducting enclosure, the capacitor comprising fixed electrodes and a rotor comprising mobile electrodes, the fixed electrodes and the mobile electrodes forming a variable capacitance able to vary a resonant frequency of the resonant cavity in a cyclic manner over time, an exterior layer of the rotor having a conductivity of greater than 20,000,000 S/m at 300 K;

wherein at least one part of an exterior surface of the rotor facing an interior surface of the conducting enclosure possesses a normal total emissivity of greater than or equal to 0.5 and less than 1, at 300 K, and wherein the at least one part of the exterior surface of the rotor or the at least one part of the interior surface of the conducting enclosure is made of a conducting diamagnetic material or a semi-conducting diamagnetic material.

2. The RF system of claim 1, wherein the rotor is not cooled by forced convection of a fluid in direct contact with the rotor.

3. The RF system of claim 1, further comprising a first means and a second means for cooling the conducting enclosure by forced convection, the second means being additional to the first means and being situated at the level of the rotor.

4. The RF system of claim 1, wherein the at least one part of the exterior surface of the rotor and the at least one part of the interior surface of the conducting enclosure are from one and the same material.

5. An RF system able to generate a voltage for accelerating charged particles in a synchrocyclotron, the RF system including a resonant cavity comprising a conducting enclosure within which are placed:

a conducting pillar of which a first end is linked to an accelerating electrode able to accelerate the charged particles; and a rotary variable capacitor coupled between a second end opposite from the first end of the pillar and the conducting enclosure, the capacitor comprising fixed electrodes and a rotor comprising mobile electrodes, the fixed electrodes and the mobile electrodes forming a variable capacitance able to vary a resonant frequency of the resonant cavity in a cyclic manner over time, an exterior layer of the rotor having a conductivity of greater than 20,000,000 S/m at 300 K;

wherein at least one part of an interior surface of the conducting enclosure facing an exterior surface of the rotor possesses a normal total emissivity of greater than or equal to 0.5 and less than 1, at 300 K, and wherein the at least one part of the exterior surface of the rotor or the at least one part of the interior surface of the conducting enclosure is made of a conducting diamagnetic material or a semi-conducting diamagnetic material.

6. The RF system of claim 5, wherein the rotor is not cooled by forced convection of a fluid in direct contact with the rotor.

7. The RF system of claim 5, further comprising a first means and a second means for cooling the conducting enclosure by forced convection, the second means being additional to the first means and being situated at the level of the rotor.

8. The RF system of claim 5, wherein the at least one part of the exterior surface of the rotor and the at least one part of the interior surface of the conducting enclosure are from one and the same material.

9. A process for manufacturing an RF system able to generate a voltage for accelerating charged particles in a synchrocyclotron, the RF system including a resonant cavity comprising a conducting enclosure within which are placed:

a conducting pillar of which a first end is linked to an accelerating electrode able to accelerate the charged particles; and a rotary variable capacitor coupled between a second end opposite from the first end of the pillar and the conducting enclosure, the capacitor comprising fixed electrodes and a rotor comprising mobile electrodes, the fixed electrodes and the mobile electrodes forming a variable capacitance able to vary a resonant frequency of the resonant cavity in a cyclic manner over time, an exterior layer of the rotor having a conductivity of greater than 20,000,000 S/m at 300 K;

wherein the process comprises applying a surface treatment to at least one part of an exterior surface of the rotor or to at least one part of an interior surface of the conducting enclosure to substantially increase a normal total emissivity, respectively, of the at least one part of the exterior surface of the rotor facing the interior surface of the conducting enclosure or of the at least one part of the interior surface of the conducting enclosure facing the exterior surface of the rotor; and wherein applying the surface treatment comprises overlaying at least one part of the exterior layer of the rotor or the at least one part of the interior surface of the conducting enclosure with a layer consisting of a conducting diamagnetic material or of a semi-conducting diamagnetic material, and in that the exterior surface of the layer consisting of the conducting diamagnetic material or of the semi-conducting diamagnetic material possesses a normal total emissivity of greater than or equal to 0.5 and less than 1, at 300 K.

10. The manufacturing process of claim 9, wherein at least one part of the exterior layer of the rotor or the at least one part of the interior surface of the conducting enclosure is made of copper, and wherein applying the surface treatment comprises oxidizing at least one part of the exterior surface of the at least one part of the exterior layer of the rotor.

11. The manufacturing process of claim 9, wherein at least one part of the exterior layer of the rotor or the at least one part of the interior surface of the conducting enclosure is made of copper, and wherein applying the surface treatment comprises mechanically increasing the roughness of at least one part of the exterior surface of the at least one part of the exterior layer of the rotor.

12. The manufacturing process of claim 9, wherein applying the surface treatment comprises overlaying at least one part of the exterior layer of the rotor or the at least one part of the interior surface of the conducting enclosure with a layer comprising a material chosen from among graphite carbon, carbon nanotubes, silicon carbide, platinum black or carbon black.

13. The manufacturing process of claim 9, wherein the at least one part of the exterior surface of the rotor and the at least one part of the interior surface of the conducting enclosure are from one and the same material.

14. The manufacturing process of claim 9, wherein the rotor is not cooled by forced convection of a fluid in direct contact with the rotor.

15. The manufacturing process of claim 9, wherein at least one part of the exterior layer of the rotor or the at least one part of the interior surface of the conducting enclosure is made of copper, and wherein applying the surface treatment comprises oxidizing at least one part of the exterior surface of the at least one part of the exterior layer of the rotor.

16. The manufacturing process of claim 9, wherein at least one part of the exterior layer of the rotor or the at least one part of the interior surface of the conducting enclosure is made of copper, and wherein applying the surface treatment comprises mechanically increasing the roughness of at least one part of the exterior surface of the at least one part of the exterior layer of the rotor.

* * * * *